US007500731B2

(12) United States Patent
Ogino et al.

(10) Patent No.: US 7,500,731 B2
(45) **Date of Patent: *Mar. 10, 2009**

(54) PRINTER AND PRINT CONTROL METHOD

(75) Inventors: Tetsuro Ogino, Shizuoka (JP); Yoshinori Takeda, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 57 days.

This patent is subject to a terminal disclaimer.

(21) Appl. No.: 11/745,093

(22) Filed: May 7, 2007

(65) Prior Publication Data

US 2007/0206036 A1 Sep. 6, 2007

Related U.S. Application Data

(63) Continuation of application No. 10/780,749, filed on Feb. 19, 2004, now Pat. No. 7,232,198.

(30) Foreign Application Priority Data

Feb. 24, 2003 (JP) ..... 2003-045825

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS 6,464,332 B1 10/2002 Silverbrook et al.
6,802,594 B2 10/2004 Silverbrook
7,232,198 B2 * 6/2007 Ogino et al. ..... 347/19
2003/0058331 A1 3/2003 Morita
2003/0085937 A1 5/2003 Otsuki

FOREIGN PATENT DOCUMENTS

| | | |
|---|---|---|
| JP | 58-008666 | 1/1983 |
| JP | 62-286778 | 12/1987 |
| JP | 4-082764 | 3/1992 |

* cited by examiner

*Primary Examiner*—Julian D Huffman
*Assistant Examiner*—Jason S Uhlenhake
(74) *Attorney, Agent, or Firm*—Pearne & Gordon LLP

(57) ABSTRACT

In a printer, an MPU makes a flash ROM store a temperature read by a temperature sensor at the time of setting of a correction value and a misalignment correction number indicating a misalignment correction value. At the time of reciprocating print motion of a printer, the printer makes the temperature sensor measure an actual ambient temperature before backward printing and obtains a difference between the present temperature and the temperature at the time of setting of the correction value. A print start delay time which indicates timing between a point of time of driving a carriage motor and a point of time of starting the backward printing is corrected in accordance with the temperature difference. The printer starts the backward printing at the timing delayed for the corrected print start delay time.

2 Claims, 11 Drawing Sheets

FIG. 4

| TEMPERATURE SUBRANGE (°C) | TEMPERATURE SUBRANGE NUMBER |
|---|---|
| -6 - -3 | 0 |
| -3 - 0 | 1 |
| 0 - 4 | 2 |
| 4 - 8 | 3 |
| 8 - 13 | 4 |
| 13 - 18 | 5 |
| 18 - 24 | 6 |
| 24 - 31 | 7 |
| 31 - 48 | 8 |
| 48 - 65 | 9 |

PRINTER AND PRINT CONTROL METHOD

CROSS-REFERENCE TO RELATED APPLICATION

This application is a continuation of U.S. patent application Ser. No. 10/780,749 filed Feb. 19, 2004, which is incorporated herein by reference in its entirety.

BACKGROUND OF THE INVENTION

1. Field of the Invention

The present invention relates to a serial printer and a print control method which reduce misalignment between forward printing and backward printing due to a change in ambient temperature.

2. Description of the Related Art

Conventionally, a serial printer conducts, as a high speed printing means, reciprocating printing (bidirectional printing) in which printing is performed both at the time of left movement and at the time of right movement, in order to improve throughput.

In the bidirectional printing, misalignment (print misalignment of backward printing relative to forward printing) is caused by backlash of a driving section such as a gear, a drive shaft or a timing belt in a carriage mechanism, shift of motor load or ribbon load, etc. It is known that the misalignment varies according to the ambient temperature in the printer (actually, the temperature of the printer itself). As the temperature decreases, the backlash, motor load or ribbon load increases, that is, the amount of misalignment tends to increase. Therefore, there has been proposed a technique in which an ambient temperature is measured at the time of printing so that a time delay is applied to printing timing of opposite direction printing to one direction printing in accordance with misalignment pre-measured at the measured temperature to thereby prevent the misalignment (e.g., see JP-A-58-8666, JP-A-62-286778 and JP-A-4-82764).

In a printer capable of performing bidirectional printing, the amount of misalignment usually varies according to deterioration with age or external factors even in the case where the temperature does not change remarkably. In JP-A-58-8666, JP-A-62-286778 and JP-A-4-82764, there is however a problem that a satisfactory misalignment correction value cannot be obtained when the amount of misalignment varies according to deterioration with age or external factors because the misalignment correction value is a fixed value.

On the other hand, there is a printer provided with a correction value setting function in which a misalignment correction value can be set by an operator. In such a printer, there is however a problem as follows. For example, when adjustment is performed outdoors at a low temperature, correlation between the estimated amount of misalignment and the actual amount of misalignment is broken if the actual service environment is at a high temperature. Accordingly, the misalignment cannot be adequately corrected even when the setting function is merely provided.

SUMMARY OF THE INVENTION

An object of the present invention is to provide a printer and a print control method in which a misalignment correction value can be easily set again even in the case where the amount of misalignment varies according to deterioration with age, external factors, or the like, and in which correction can be made automatically to minimize misalignment even in the case where a temperature actually used is different from an ambient temperature at the time of setting of the misalignment correction value.

The present invention provides a printer comprising: a print head for making reciprocating motion transversely with respect to a recording medium to thereby perform both forward printing and backward printing on the recording medium; a misalignment correction unit for correcting misalignment between the forward printing and the backward printing; a temperature detection unit for detecting an ambient temperature; a setting unit for setting a correction reference value for the misalignment correction unit; a storage unit for storing the correction reference value set by the setting unit and the ambient temperature detected by the temperature detection unit when the correction reference value is set; and a calculation unit for calculating a misalignment correction value by revising the correction reference value on the basis of a result of comparison between the ambient temperature stored in the storage unit and an ambient temperature at the time of printing; wherein the misalignment correction unit corrects misalignment on the basis of the misalignment correction value calculated by the calculation unit.

According to the printer of the invention, the correction reference value resettably set by the setting unit and the ambient temperature detected by the temperature detection unit at the time of setting of the correction reference value are stored in the storage unit. The calculation unit calculates a misalignment correction value by revising the correction reference value on the basis of a result of comparison between the ambient temperature stored in the storage unit and the ambient temperature at the time of printing. The misalignment correction unit corrects misalignment between the forward printing and the backward printing on the basis of the calculated misalignment correction value. Accordingly, the misalignment can be minimized even in the case where the temperature at the time of actual use of the printer is different from the ambient temperature at the time of setting of the correction reference value.

Preferably, in the printer according to the invention, the storage unit stores a temperature subrange table on which consecutive numbers for indicating temperature subranges respectively are assigned to the temperature subranges obtained by dividing an available temperature range of the printer on the basis of the amount of misalignment at each temperature in such a manner that a temperature subrange larger in the amount of misalignment is narrower than a temperature subrange smaller in the amount of misalignment; and the calculation unit refers to the temperature subrange table, decides a temperature subrange including the ambient temperature detected by the temperature detection unit and calculates the misalignment correction value by revising the correction reference value on the basis of a difference between a number stored in the storage unit and indicating a temperature subrange including the ambient temperature detected at the time of setting of the correction reference value and a number indicating a temperature subrange including a present ambient temperature detected by the temperature detection unit. In this configuration, correction can be performed based on the actual relation between the amount of misalignment and the ambient temperature so that the misalignment amount can be minimized.

The invention further provides a print control method for correcting misalignment between forward printing and backward printing when a print head makes reciprocating motion transversely with respect to a recording medium to thereby perform both the forward printing and the backward printing on the recording medium, the method comprising the steps of: providing a setting mode for setting a correction reference value; storing the set correction reference value and an ambient temperature at the time of setting of the correction reference value; and calculating a misalignment correction value by revising the correction reference value on the basis of a result of comparison between the ambient temperature at the time of setting of the correction reference value and an ambient temperature at the time of printing to thereby correct misalignment on the basis of the calculated misalignment correction value.

According to the print control method of the invention, a misalignment correcting mode is carried out as follows. That is, the set correction reference value and the ambient temperature at the time of setting of the correction reference value are stored. The correction reference value is revised on the basis of the result of comparison between the ambient temperature at the time of setting of the correction reference value and the ambient temperature at the time of printing to thereby calculate a misalignment correction value. Misalignment is corrected based on the calculated misalignment correction value. Accordingly, the correction reference value used for correcting misalignment can be easily set again even in the case where the amount of misalignment varies according to deterioration with age, external factors, or the like. Thus, the misalignment can be minimized even in the case where the temperature actually used is different from the ambient temperature at the time of setting of the correction reference value.

BRIEF DESCRIPTION OF THE DRAWINGS

FIG. 4 is a conceptual view showing an example of a correction table.

DETAILED DESCRIPTION OF THE PREFERRED EMBODIMENTS

An embodiment of the invention will be described below with reference to the drawings.

A. Configuration of Embodiment

A-1. Configuration of Printer

Figure 1:
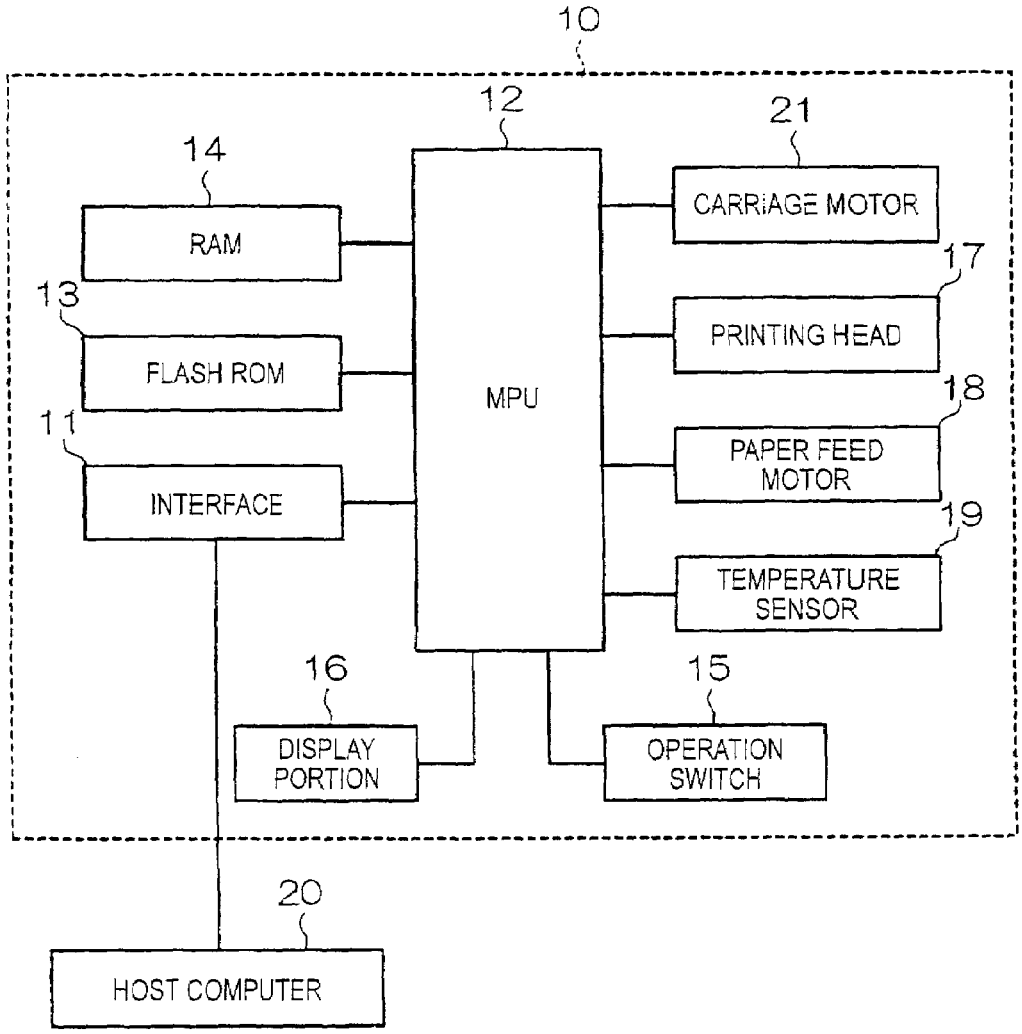
FIG. 1 is a block diagram showing the basic configuration of a printer according to an embodiment of the invention.

FIG. 1 is a block diagram showing the basic configuration of a printer according to an embodiment of the invention. In FIG. 1, a printer 10 has a mechanical section, a circuit section, etc. The circuit section mainly has an interface 11, an MPU 12, a flash ROM 13, an RAM 14, an operating switch 15, and a display portion 16. The interface 11 is connected to a host computer 20 so as to transmit/receive data thereto/therefrom. The MPU 12 controls the printer as a whole. The flash ROM 13 is a rewritable nonvolatile memory in which programs, character font data, mechanical driving conditions and so on are stored. The RAM 14 is a rewritable volatile memory which is used for variables, flags, character expansion areas, etc., when the printer is controlled. The operating switch 15 is a push switch which can be operated by an operator. The display portion 16 has LEDs for indicating the state of the printer.

The mechanical section has a print portion, and a paper feed portion. The print portion mainly has a carriage (not shown), a carriage motor 21, and a print head 17. The paper transport portion mainly has a paper feed motor 18, and paper feed rollers (not shown) The print head 17 prints characters or graphics on a recording medium such as a sheet of paper under the control of the MPU 12. The paper feed motor 18 transports the recording medium in a feeding direction under the control of the MPU 12. Printing is performed as follows. The print head 17 is supplied with a current while the carriage moves the print head 17 in a direction perpendicular to the feeding direction in which the recording medium is fed by the paper feed motor 18. As a result, characters or graphics are printed on the recording medium.

A temperature sensor 19 is a thermister type sensor for measuring an ambient temperature inside the printer. The temperature sensor 19 may be attached to a desired place in the printer 10. In this embodiment, the temperature sensor 19 is mounted on a circuit board.

A-2. Relation between Misalignment and Ambient Temperature

Figure 2:
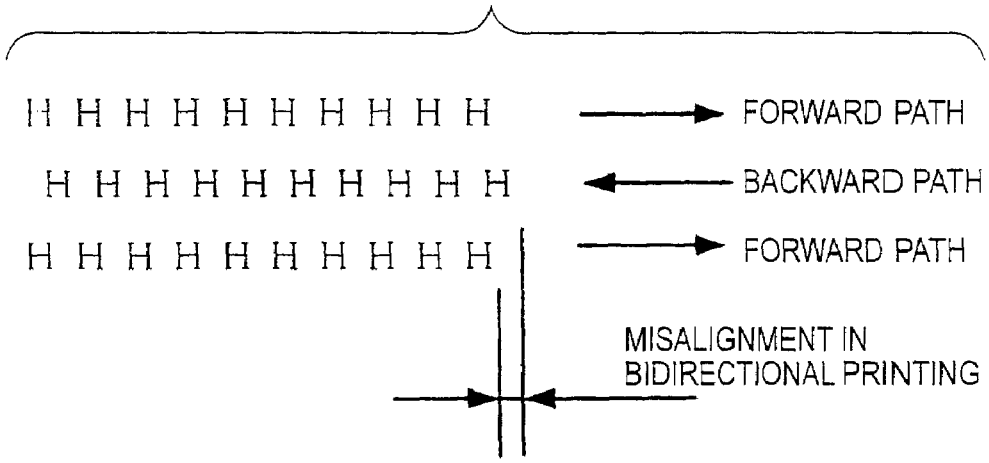
FIG. 2 is a typical view for explaining misalignment between forward printing and backward printing in the printer.
Figure 3:
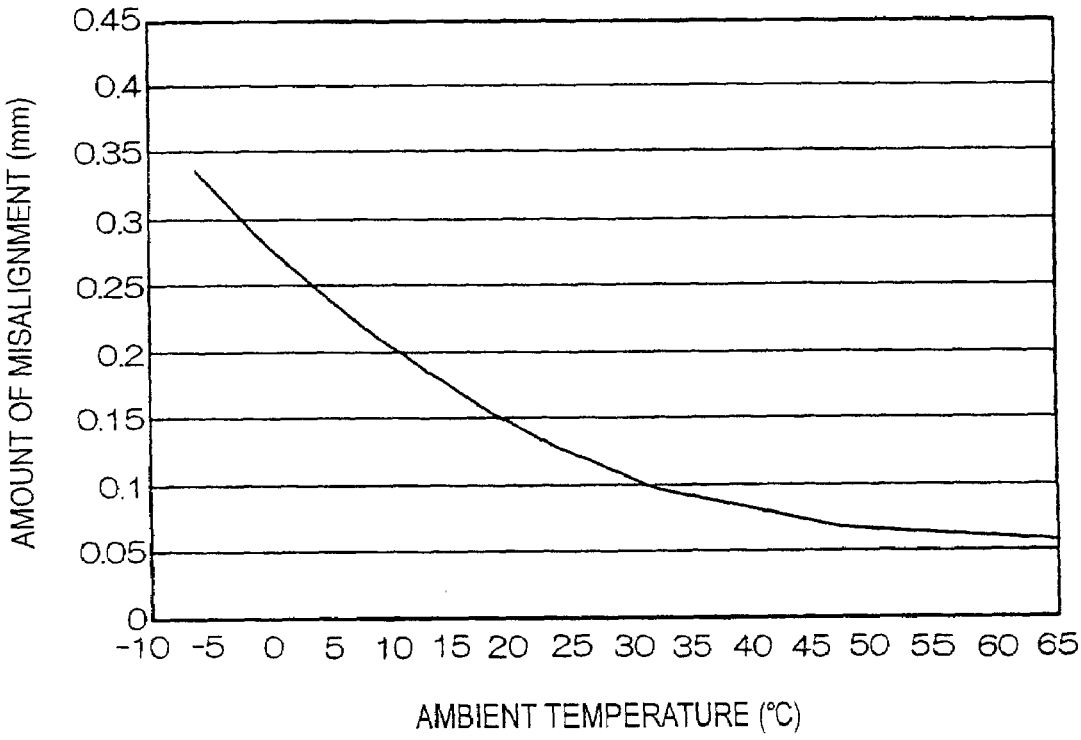
FIG. 3 is a conceptual graph showing the relation between an ambient temperature and a misalignment amount.

Misalignment varies according to the ambient temperature in the printer (actually, the temperature inside the printer). FIG. 2 is a typical view for explaining misalignment between forward printing and backward printing in a serial printer. FIG. 3 is a conceptual graph showing the relation between the ambient temperature and the amount of misalignment of the backward printing relative to the forward printing. As shown in FIG. 2, in the printer 10, a delay relative to a theoretical printing position occurs due to backlash of the mechanical section or load on each section, so that misalignment occurs between the forward printing and the backward printing. The backlash or load increases as the ambient temperature decreases. As shown in FIG. 3, the amount of misalignment increases as the temperature decreases, and the amount of misalignment decreases as the temperature increases.

In this embodiment, a correction table is prepared. An available temperature range (−6° C. to 65° C.) of the ambient temperature is divided into a plurality of temperature subranges in consideration of the relation between the ambient temperature and the amount of misalignment as shown in FIG. 3. The temperature subranges and temperature subrange numbers assigned to the temperature subranges respectively are recorded on the correction table. The temperature range is divided so unequally that the lower temperature subrange is narrower than the higher temperature subrange. That is, the temperature range is divided so unequally that the accumulated amount of misalignment in one temperature subrange is substantially equal to that in another temperature subrange. FIG. 4 is a conceptual view showing an example of the correction table. In the example shown in FIG. 4, temperature subrange number "0" is assigned to a temperature subrange "−6 to −3° C.", temperature subrange number "1" is assigned to a temperature subrange "−3 to 0° C.", temperature subrange number "2" is assigned to a temperature subrange "0 to 4° C.", . . . , and temperature subrange number "9" is assigned to a temperature subrange "48 to 65° C.". The correction table is stored in the flash ROM 13.

A-3. Basic Control of Misalignment Correction

In this embodiment, print start timing is delayed for a proper value (a print start delay time is set) with respect to the drive timing of the carriage motor on the forward path and/or the backward path so that the amount of misalignment in an actual printing result can be minimized. In this manner, misalignment between forward printing and backward printing is corrected (in this embodiment, only the print start delay time at the backward printing will be described for the sake of simplification).

More specifically, the ambient temperature at the time of setting of the correction reference value, as well as the print start delay value set at the time of setting of the correction reference value, is stored in the flash ROM 13 in advance. In an actual printing operation, the print start delay time at the backward printing is corrected in accordance with the difference between the ambient temperature stored in the flash ROM 13 and the present ambient temperature. Incidentally, the correction reference value will be described later.

B. Operation of Embodiment

Next, the operation of the printer according to the embodiment of the invention will be described. FIGS. 5 to 9 are flow charts for explaining the operation of the printer according to this embodiment.

B-1. Basic Operation

Figure 5:
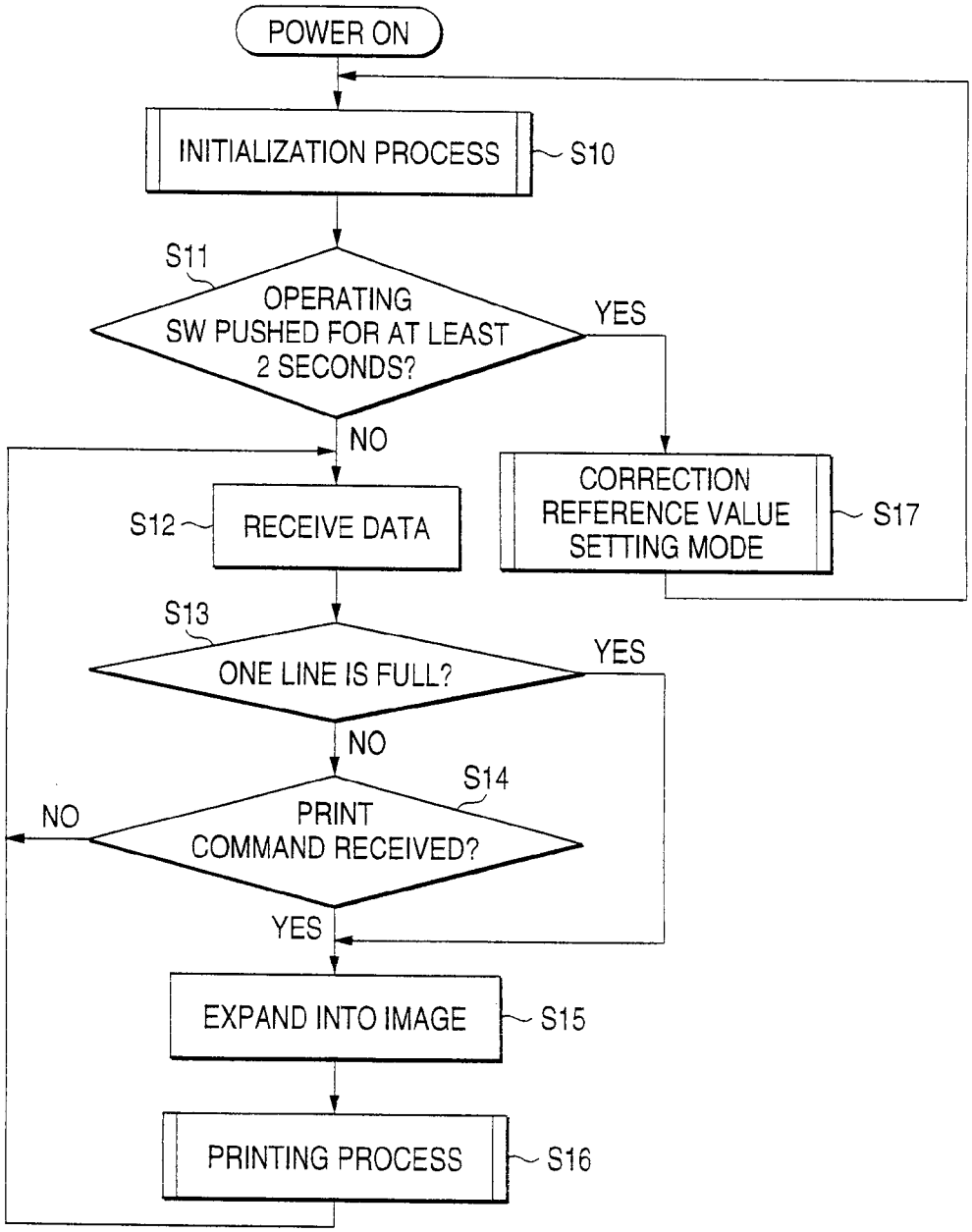
FIG. 5 is a flow chart for explaining the basic operation of the printer.

First, the basic operation of the printer 10 will be described with reference to FIG. 5. As soon as the printer 10 is powered on, the printer 10 in Step S10 performs an initialization process such as initialization of each section, setting of the print start delay time Dtf/Dtb at the forward/backward printing, initial operations of mechanism, etc. The details of the initialization process will be described later. Next, in Step S11, the printer 10 judges whether the operating switch 15 has been pushed for at least 2 seconds or not. The printer 10 according to this embodiment is designed to shift to a correction reference value setting mode when the operating switch 15 has been pushed for 2 seconds or more since the printer 10 is powered on. The correction reference value setting mode will be described later.

When the operating switch 15 has not been operated, the printer 10 in Step S12 is enabled to receive data from the host computer 20. When the printer 10 receives print data or command data from the host computer 20, the data is stored in the RAM 14 through the interface portion 11.

Next, in Step S13, the printer 10 judges whether one-line's data required for starting printing has been received or not. In Step S14, the printer 10 judges whether a print start command for instructing the printer 10 to start printing has been received or not. When the printer 10 then receives the data required for starting printing (e.g. the whole one-line's data or the print start command), the printer 10 in Step S15 expands character data into an image on the RAM 14. In Step S16, the printer 10 drives the carriage motor to perform a printing process for bidirectional printing.

On the contrary, when the operating switch 15 has been pushed for 2 seconds or more since the printer 10 is powered on, the printer 10 in Step S17 executes the correction reference value setting mode. The details of the correction reference value setting mode will be described later.

B-2. Initialization Process

Figure 6:
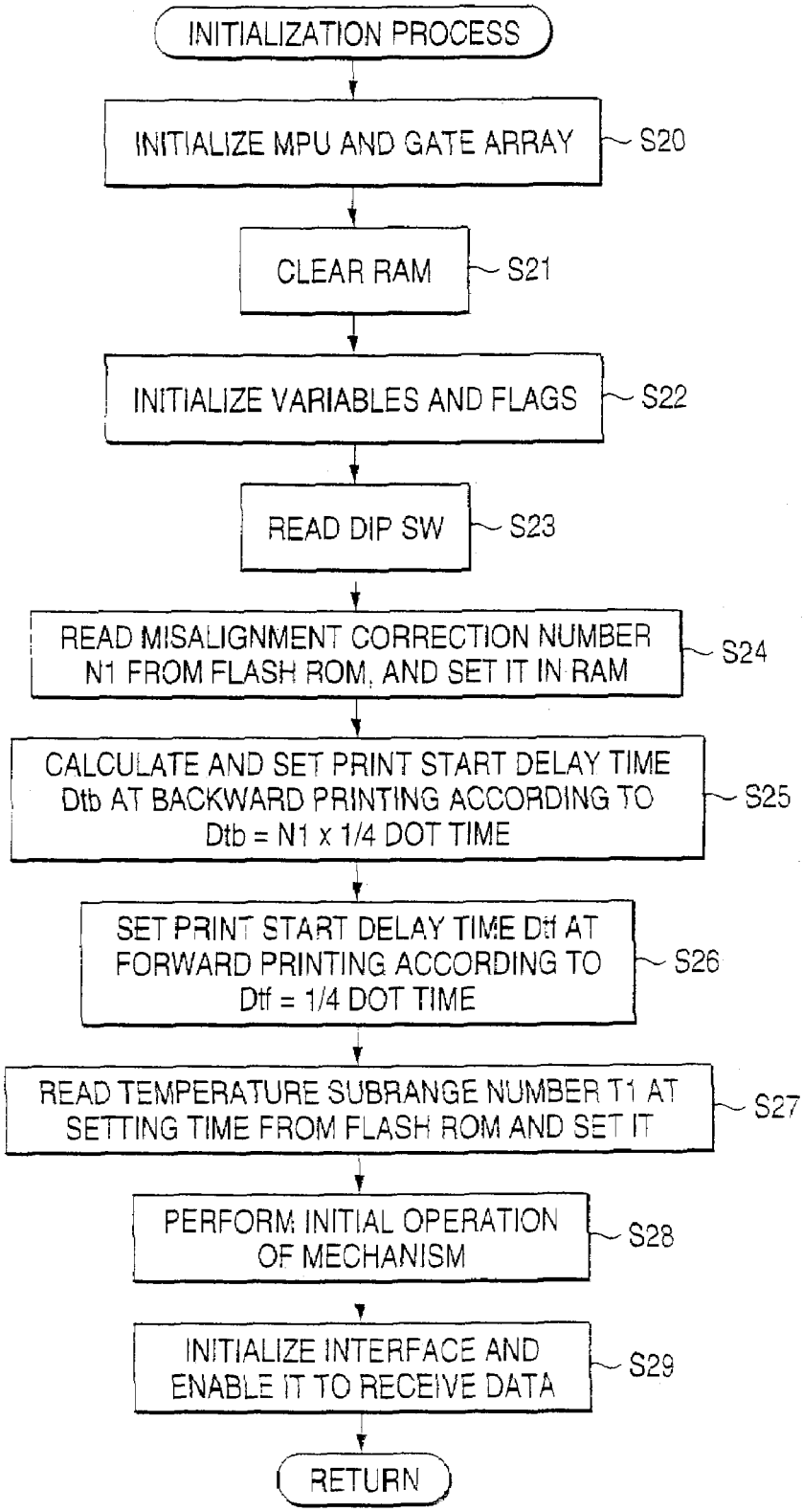
FIG. 6 is a flow chart for explaining the operation of the printer in an initialization process.

Next, the initialization process will be described with reference to FIG. 6. First, in Step S20 of the initialization process, the MPU 12, a gate array, etc. are initialized. In Step S21, the RAM 14 is cleared. Next, in Step S22, various variables and flags are initialized. In Step S23, the set state of a DIP switch for setting the operating state is read. In Step S24, a misalignment correction number N1 is read from the flash ROM 13 and set in the RAM 14. The details of the misalignment correction number N1 will be described later.

Next, in Step S25, the print start delay time Dtb at the backward printing is calculated and set by use of the misalignment correction number N1 according to the expression "Dtb=N1×¼ dot time (225 microseconds in this embodiment)". Next, in Step S26, the print start delay time Dtf at the forward printing is set (at ¼ dot time: fixed value). Next, in Step S27, a temperature subrange number T1 at the time of setting of the correction reference value is read from the flash ROM 13 and set. The details of the temperature subrange number T1 will be described later. Next, in Step S28, initial operations of mechanism are performed. In Step S29, the interface is initialized to be enabled to receive data.

B-3. Correction Reference Value Setting Mode

Figure 7:
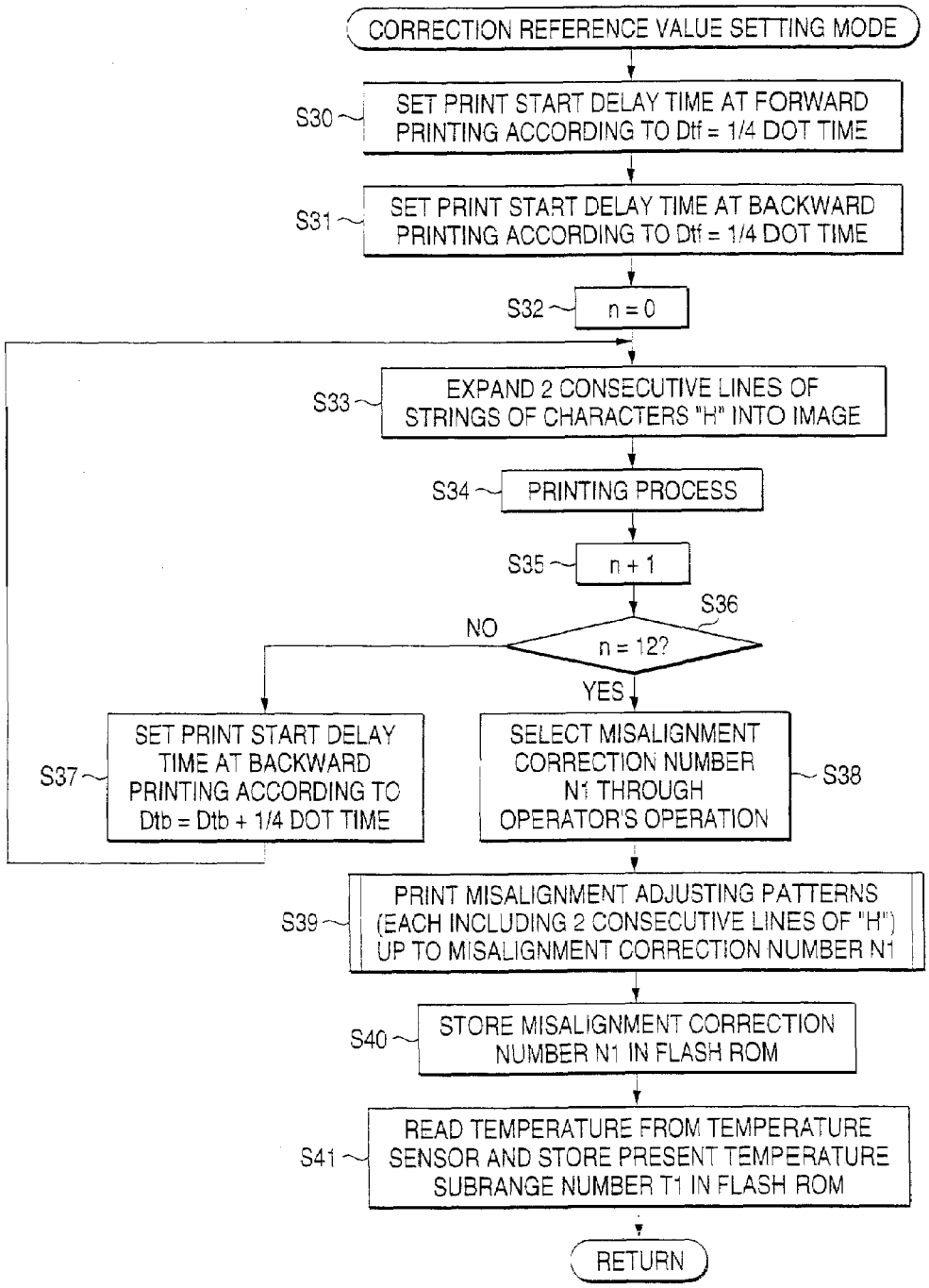
FIG. 7 is a flow chart for explaining the operation of the printer in a correction reference value setting mode.

Next, the correction reference value setting mode will be described with reference to FIG. 7. The print start delay time is set in the correction reference value setting mode at the time of shipment from a factory or at the time of maintenance because the print start delay time varies individually according to the mechanical section. In the correction reference value setting mode, a plurality of correction reference value setting patterns having printing start delays shifted from one another stepwise are printed on a recording medium, and a proper value is selected by operator's decision and stored in the flash ROM 13. Detailed description will be made below.

First, in Step S30 of the correction reference value setting mode, the print start delay time Dtf at the forward printing is set at ¼ dot time. In Step S31, the print start delay time Dtb at the backward printing is set at ¼ dot time. Next, in Step S32, a variable n is set at 0. In Step S33, two lines each having a string of characters "H" (correction reference value setting pattern) are expanded into an image. In Step S34, the printing process (for the two lines) is executed. Next, in Step S35, the variable n is increased by "1". In Step S36, a judgment is made as to whether the variable n has reached 12 or not. When the variable n has not reached 12, in Step S37, the print start delay time Dtb at the backward printing is increased by "¼ dot time", and the current position of this routine goes back to Step S33.

Figure 10:
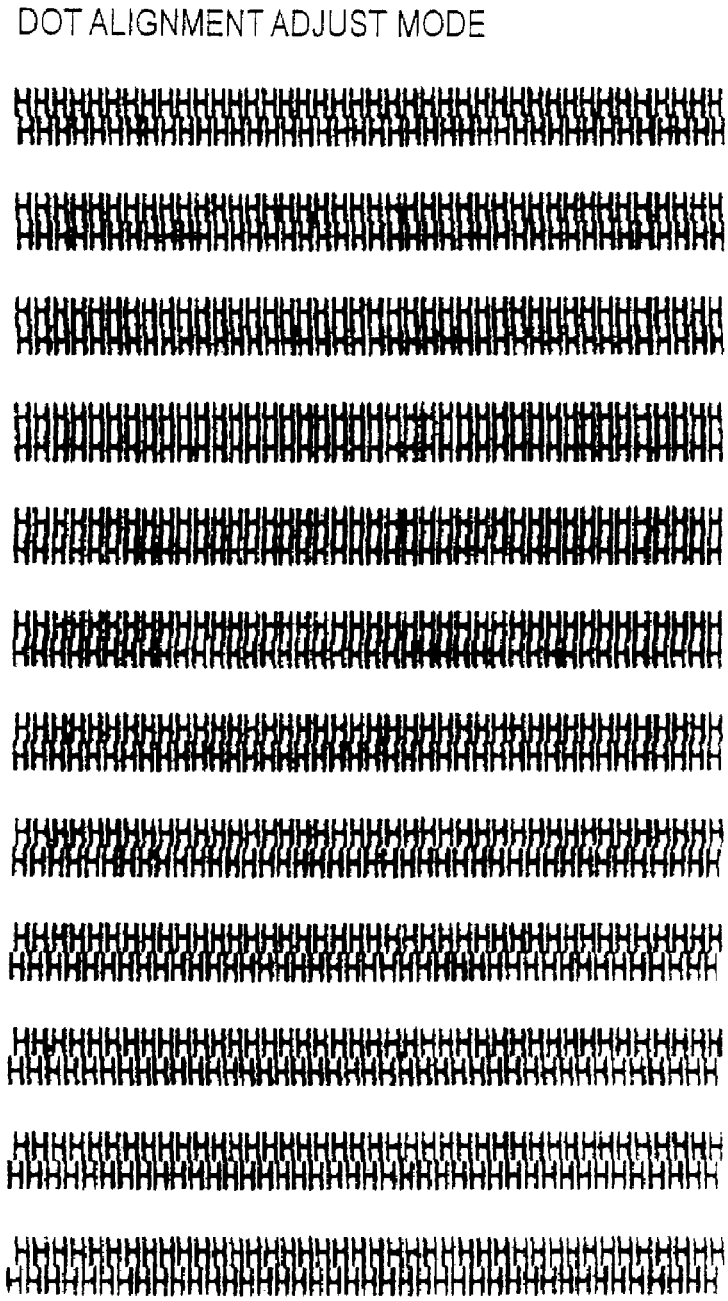
FIG. 10 is a typical view showing an example of correction reference value setting patterns printed in the correction reference amount value mode.

Then, Steps S33 to S37 are repeated until the variable n reaches 12. As a result, as shown in FIG. 10, twelve setting patterns each having a pair of lines of characters "H" are printed. Of each pair, the upper line is printed on the forward path and the lower line is printed on the backward path. In addition, the string of characters "H" in the lower line printed on the backward path in each setting pattern is printed in the condition that the print start delay time Dtb at the backward printing is increased by "¼ dot time" in comparison with that in the previous setting pattern. That is, as the variable n increases, the lower line is printed while shifted to the left in FIG. 10 with respect to the upper line.

When the variable n reaches 12, in Step S38, the operator confirms the setting patterns shown in FIG. 10, selects a setting pattern with the smallest misalignment value, and inputs a misalignment correction number N1 (selected from numbers "1" to "12") corresponding to the selected setting pattern through the operating switch 15. In the example shown in FIG. 10, the fourth printed pattern from the top has the smallest misalignment value, and the positions of the string of characters "H" printed on the forward path coincide with the positions of the string of characters "H" printed on the backward path. In this case, the operator inputs "4" as the misalignment correction number N1. A correction value set on the basis of the misalignment correction number N1 is the correction reference value in this embodiment. Although the misalignment correction number N1 corresponding to each setting pattern is not printed in the example shown in FIG. 10, the misalignment correction number N1 corresponding to each setting pattern may be printed together with the string of characters "H" so that the misalignment correction number N1 can be easily selected by the operator.

Next, in Step S39, correction reference value setting patterns (each having a pair of lines each having a string of characters "H") corresponding to the misalignment correction number 1 to the input misalignment correction number N1 are printed in order to notify the operator of the misalignment correction number set by the operator. In Step S40, the misalignment correction number N1 is stored in the flash ROM 13. Next, in Step S41, the temperature detected by the temperature sensor 19 is read, and a temperature subrange number T1 corresponding to the read temperature is stored in the flash ROM 13 with reference to the temperature subranges shown in FIG. 4. When, for example, the temperature sensor 19 reads 30° C. as the present temperature, "7" selected from FIG. 4 is stored as the temperature subrange number T1. The misalignment correction number N1 corresponds to the variable N1 read in the Step S24 of the initialization process. The print start delay time Dtb at the backward printing is set in accordance with the misalignment correction number N1 set in the correction reference value setting mode.

B-4. Printing Process

Figure 11:
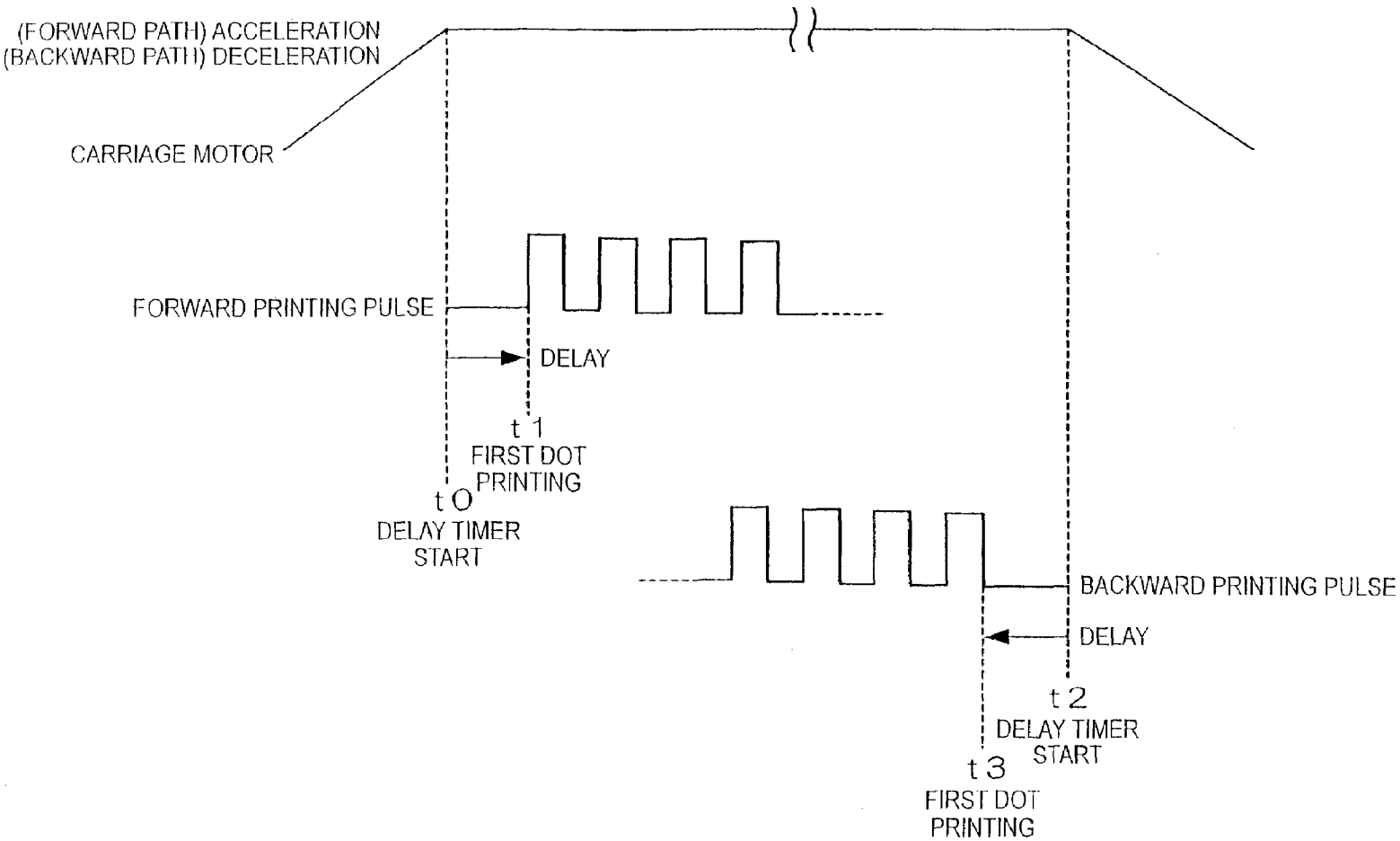
FIG. 11 is a timing chart for explaining the operation of the printer in the printing process.

Next, the printing process will be described with reference to FIGS. 8 and 9. FIG. 11 is a timing chart for explaining the operation in the printing process. First, in Step S50 of the printing process, a judgment is made as to whether printing is backward printing or not. In the case of forward printing, in Step S51, the print start delay time Dtf at the forward printing is set as a print start delay timer value Dtm. Next, in Step S55, energization of carriage motor drive pulses starts. In Step S56, a judgment is made as to whether the print head 17 has reached a theoretical print start position of the forward path or not. When the print head 17 has reached the theoretical print start position of the forward path at a point of time t0 shown in FIG. 11, in Step S57, a delay timer starts at the print start delay timer value Dtm.

Figure 9:
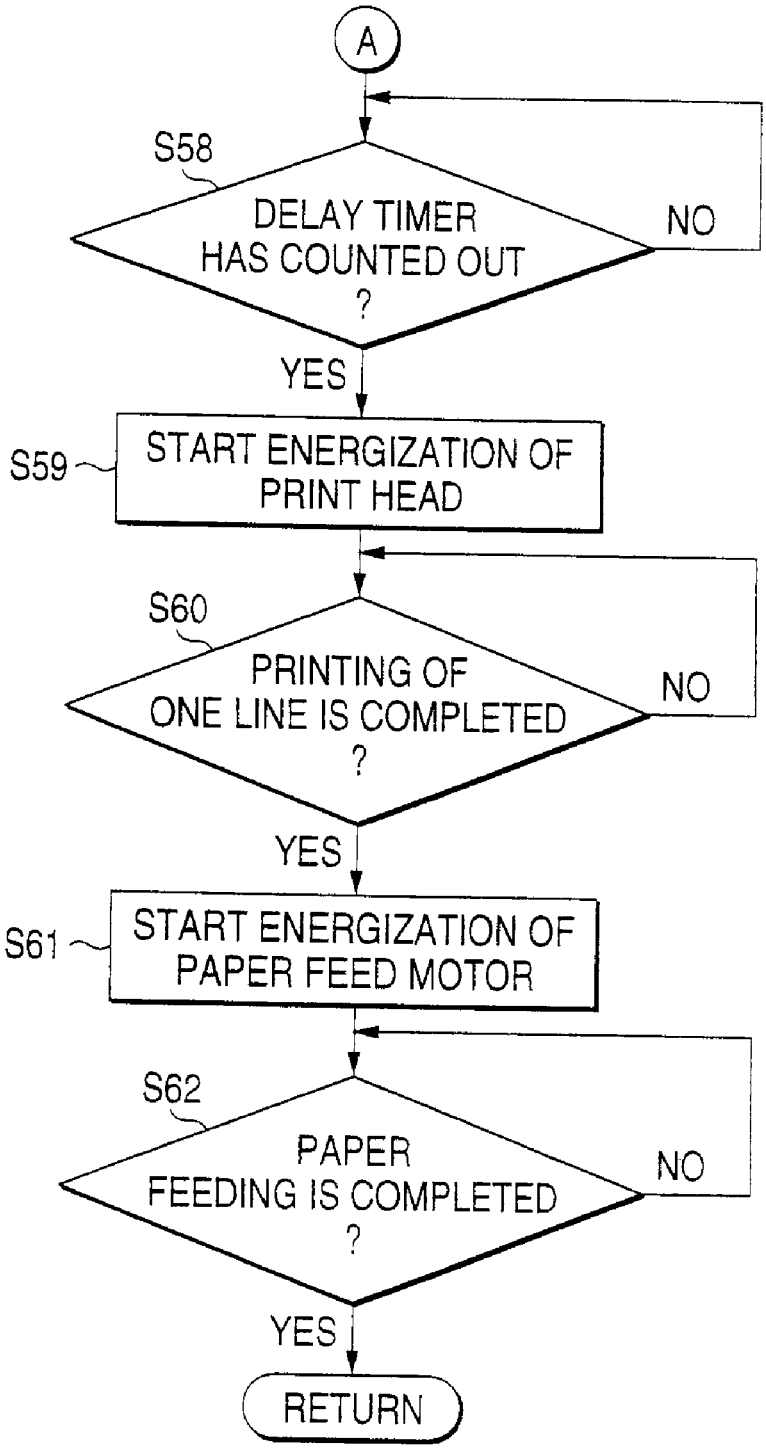
FIG. 9 is a flow chart for explaining the operation of the printer in the printing process.

Next, in Step S58 in FIG. 9, a judgment is made as to whether the delay timer has counted out or not. If not so, the delay timer continues counting until it counts out. When the delay timer counts out at a point of time t1 shown in FIG. 11, in Step S59, energization of the print head 17 starts to perform printing on the recording medium. Next, in Step S60, a judgment is made as to whether printing of one line (on the forward path in this case) is completed or not. If not so, the printing operation is continued until the printing of one line is completed. When the printing of one line is completed, in Step S61, energization of the paper feed motor 18 starts to move the recording medium in the paper feeding direction. In Step S62, a judgment is made as to whether a predetermined value of paper feeding is completed or not. When paper feeding is completed, the current position of the printing process goes back to the initial step.

Figure 8:
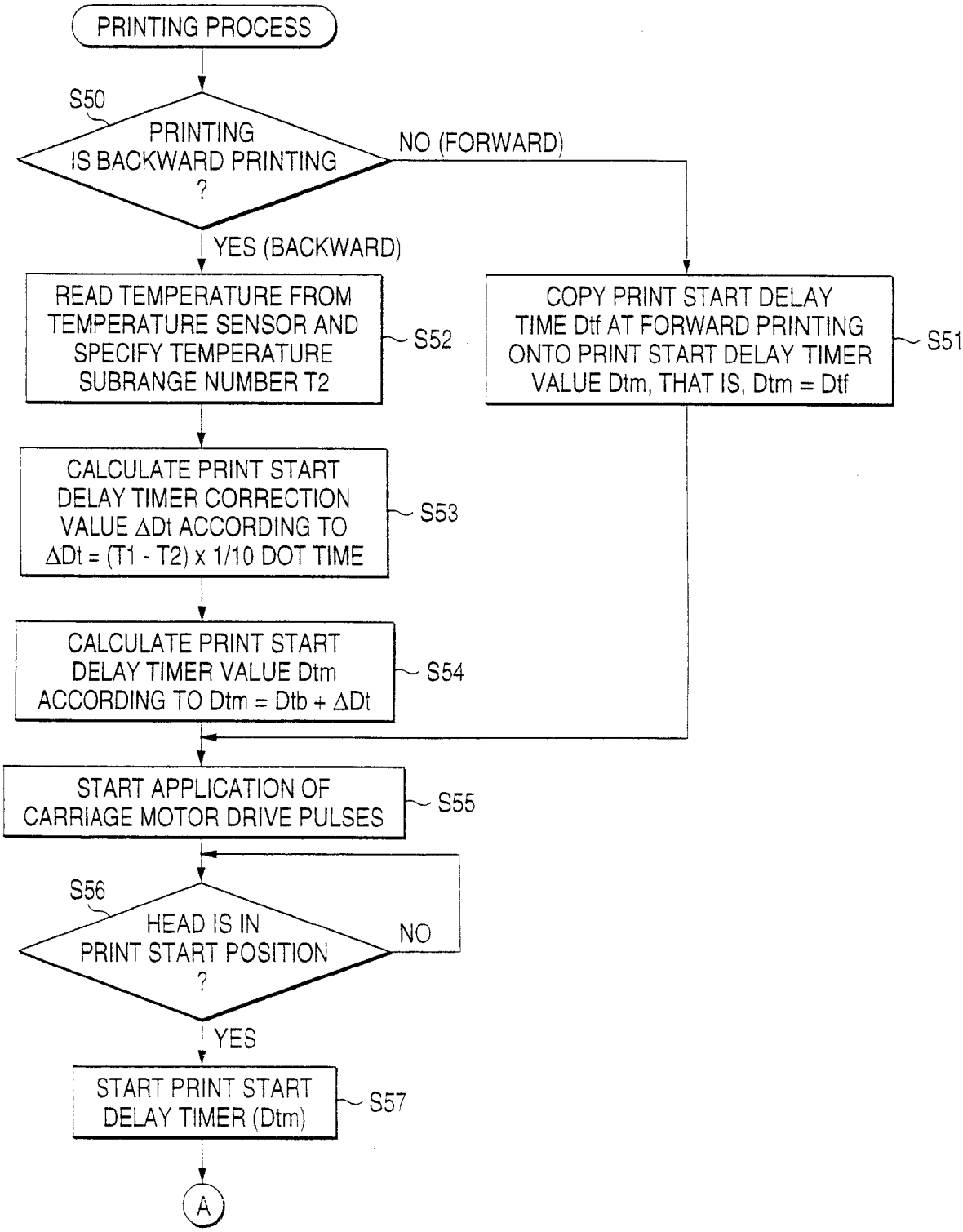
FIG. 8 is a flow chart for explaining the operation of the printer in a printing process.

On the other hand, in the case of backward printing, in Step S52 in FIG. 8, the present temperature detected by the temperature sensor 19 is read, and a temperature subrange number T2 corresponding to the read present temperature is set with reference to the temperature subranges shown in FIG. 4. Next, in Step S53, the print start delay timer correction value ΔDt is calculated according to the expression "ΔDt=(T1−T2)×1/10 dot time (90 microseconds in this embodiment)" based on the temperature at the time of printing (temperature subrange number T2) and the temperature at the time of setting of the correction reference value (temperature subrange number T1). Incidentally, in the printing process, the print start delay timer correction value ΔDt is not calculated during the setting of the correction reference value. That is, ΔDt=0.

Next, the print start delay timer value Dtm at the backward printing is calculated according to the expression "Dtm=Dtb+ΔDt". Similarly to the forward printing, in Step S55, energization of carriage motor drive pulses starts. In Step S56, a judgment is made as to whether the print head 17 has reached a theoretical print start position of the backward path or not. When the print head 17 reaches the theoretical print start position of the backward path at a point of time t2 shown in FIG. 11, in Step S57, the delay timer starts at the print start delay timer value Dtm.

Next, in Step S58 in FIG. 9, a judgment is made as to whether the delay timer has counted out or not. If not so, the delay timer continues counting until it counts out. When the delay timer counts out at a point of time t3 shown in FIG. 11, in Step S59, energization of the print head 17 starts to perform printing on the recording medium. Next, in Step S60, a judgment is made as to whether printing of one line (on the backward path in this case) is completed or not. If not so, the printing operation is continued until the printing of one line is completed. When the printing of one line is completed, in Step S61, energization of the paper feed motor 18 starts to move the recording medium in the paper feeding direction. In Step S62, a judgment is made as to whether a predetermined value of paper feeding is completed or not. When paper feeding is completed, the current position of the printing process goes back to the initial step.

Accordingly, in the backward printing in this embodiment, printing starts at timing delayed for a print start delay time corrected in accordance with the difference between the temperature at the time of setting of the correction reference value and the present temperature with respect to the point of time when the print head 17 reaches the theoretical print start position. Accordingly, a printing result with minimized misalignment can be obtained even when the printer is used under an ambient temperature environment different from that at the time of setting of the correction reference value.

C. SPECIFIC EXAMPLE

Assume that the actual service temperature is −1° C. (temperature subrange number=1) though setting of the correction reference value is performed (misalignment correction number=3) at an ambient temperature of 35° C. (temperature subrange number=8). Then, the print start delay timer value Dtm is given by Dtm=3×225 msec+(8−1)×90 msec=1305 msec. Assume that the service temperature reaches 50° C. (temperature subrange number=9) when printing is continued. Then, the print start delay timer value Dtm is given by Dtm=3×225 msec+(8−9)×90 msec=585 msec.

Assume that the actual service temperature is −1° C. (temperature subrange number=1) though setting of the correction reference value is performed (misalignment correction number=7) at an ambient temperature of 10° C. (temperature subrange number=4) because the misalignment correction value needs to be set again due to deterioration with age or external factors. Then, the print start delay timer value Dtm is given by Dtm=7×225 msec+(4−1)×90 msec=1845 msec. Assume that the service temperature reaches 50° C. (temperature subrange number=9) when printing is continued. Then, the print start delay timer value Dtm is given by Dtm=7×225 msec+(4−9)×90 msec=1125 msec.

As described above, in accordance with this embodiment, because a correction reference value setting function is provided, the correction reference value can be easily set by the operator at a desired ambient temperature even if misalignment occurs due to deterioration with age or external factors. Moreover, even if there is a difference between the ambient temperature at the time of setting of the correction reference value and the ambient temperature used actually, printing can be performed so that the amount of misalignment is minimized. In other words, the correction reference value is revised in accordance with the actual change of the temperature environment to thereby correct misalignment regardless of the temperature at the time of setting of the correction reference value. Accordingly, temperature compensation for misalignment caused by deterioration with age or external factors can be attained without complicated control.

Although the embodiment has shown the case where a dot impact printer is used, the invention is applicable to any type of serial drive printer such as an ink jet printer or a serial thermal printer. In addition, when the method of dividing the temperature range into temperature subranges (finely or roughly) or the unit delay time equivalent to one temperature subrange is optimized, the invention can be adapted to various temperature compensation curves. Although the embodiment has shown the case where the print start delay time at the backward printing is corrected for each line (on the forward/backward path), the invention is not limited thereto. For example, the print start delay time at the backward printing may be corrected based on a predetermined number of copies to be processed, a predetermined lapsed time, or the like. Further, the correction reference value may be set on the basis of to the number of pulses applied to the carriage motor 21, the count number of an encoder, or the like.

As described above, according to the invention, because the correction reference value is set by a setting unit, there is obtained an advantage that the correction reference value used for correcting misalignment can be easily set again when the misalignment value changes due to deterioration with age, external factors, or the like. In addition, the correction reference value set by the setting unit and the ambient temperature detected by a temperature detection unit at the time of setting of the correction reference value are stored in a storage unit. A calculation unit calculates a misalignment correction value by revising the correction reference value on the basis of a result of comparison between the ambient temperature stored in the storage unit and the ambient temperature at the time of printing. A misalignment correction unit corrects misalignment between forward printing and backward printing on the basis of the calculated misalignment correction value. Accordingly, there is obtained an advantage that the misalignment can be minimized even in the case where the ambient temperature used actually is different from the ambient temperature at the time of setting of the correction reference value.

What is claimed is:

1. A printer comprising:

a print head for making reciprocating motion transversely with respect to a recording medium to thereby perform both forward printing and backward printing on the recording medium;

a misalignment correction unit for correcting misalignment between the forward printing and the backward printing;

a setting unit for setting a correction reference value for the misalignment correction unit;

a first temperature detection unit for detecting an ambient temperature of the printer as a first temperature when setting the correction reference value by the setting unit;

a second temperature detection unit for detecting an ambient temperature of the printer as a second temperature when performing the printing by the printer;

a correction reference value storage unit for storing the correction reference value set by the setting unit;

a first temperature storage unit for storing the first temperature detected by the first temperature detection unit; and a calculation unit for calculating a misalignment correction value by revising the correction reference value read out from the correction reference value storage unit on the basis of a result of comparison between the first temperature read out from the first temperature storage unit and the second temperature detected by the second temperature detection unit, wherein the misalignment correction unit corrects misalignment on the basis of the misalignment correction value calculated by the calculation unit, and wherein the correction reference value storage unit stores a temperature subrange table comprising the temperature subranges obtained by dividing an available temperature range of the printer unequally so that a lower temperature subrange is narrower than a higher temperature subrange, and as a result, unequal divisions of the temperature range allow an accumulated amount of misalignment in one temperature subrange to be substantially equal to that in another temperature subrange.

2. A print control method for correcting misalignment between forward printing and backward printing when a print head makes reciprocating motion transversely with respect to a recording medium to thereby perform both the forward printing and the backward printing on the recording medium, the method comprising:

providing a setting mode for setting a correction reference value for correcting the misalignment;

storing the set correction reference value and an ambient temperature of a printer as a first temperature at the time of setting of the correction reference value; and calculating a misalignment correction value by revising the correction reference value on the basis of a result of comparison between the first temperature and an ambient temperature of the printer at the time of printing as a second temperature to thereby correct misalignment on the basis of the calculated misalignment correction value, wherein the correction reference value is chosen from a temperature subrange table comprising the temperature subranges which are obtained by dividing an available temperature range of the printer unequally so that a lower temperature subrange is narrower than a higher temperature subrange, and as a result, unequal divisions of the temperature range allow an accumulated amount of misalignment in one temperature subrange to be substantially equal to that in another temperature subrange.

* * * * *